US009675221B2

(12) United States Patent
Liao et al.

(10) Patent No.: US 9,675,221 B2
(45) Date of Patent: Jun. 13, 2017

(54) RECYCLING CLEANING DEVICE

(71) Applicants: Ying-Chieh Liao, Taichung (TW); Yu-Kuo Liao, Taichung (TW)

(72) Inventors: Ying-Chieh Liao, Taichung (TW); Yu-Kuo Liao, Taichung (TW)

( * ) Notice: Subject to any disclaimer, the term of this patent is extended or adjusted under 35 U.S.C. 154(b) by 0 days.

(21) Appl. No.: 14/930,132

(22) Filed: Nov. 2, 2015

(65) Prior Publication Data

US 2017/0119222 A1 May 4, 2017

(51) Int. Cl.

| | |
|---|---|
| ***A47L 5/12*** | (2006.01) |
| ***A47L 7/00*** | (2006.01) |
| ***A47L 9/10*** | (2006.01) |
| ***A47L 9/06*** | (2006.01) |
| ***A47L 9/24*** | (2006.01) |
| *A47L 5/38* | (2006.01) |

(52) U.S. Cl.

CPC ..... *A47L 7/0033* (2013.01); *A47L 9/06* (2013.01); *A47L 9/104* (2013.01); *A47L 9/24* (2013.01); *A47L 5/12* (2013.01); *A47L 5/38* (2013.01)

(58) Field of Classification Search

CPC .. B08B 3/006; B08B 3/00; B08B 3/04; B08B 3/06; B08B 3/02; A47L 7/0033; A47L 9/24; A47L 9/06; A47L 9/104; A47L 5/12; A47L 5/38

USPC ..... 134/104.4, 108, 111

See application file for complete search history.

(56) References Cited

U.S. PATENT DOCUMENTS

| | | | | |
|---|---|---|---|---|
| 3,522,814 A * | 8/1970 | Olson | B08B 3/006 134/111 |
| 3,890,988 A * | 6/1975 | Lee | B08B 3/006 134/10 |
| 4,122,861 A * | 10/1978 | Lee | B08B 3/006 134/109 |
| 4,817,649 A * | 4/1989 | Schmalz, Jr. | B08B 3/006 134/113 |
| 6,068,707 A * | 5/2000 | Magliocca | B01D 33/11 134/10 |

FOREIGN PATENT DOCUMENTS

| | | |
|---|---|---|
| TW | 370903 | 9/1999 |

* cited by examiner

*Primary Examiner* — David Redding

(74) *Attorney, Agent, or Firm* — Muncy, Geissler, Olds & Lowe, P.C.

(57) ABSTRACT

A recycling cleaning device includes a tub body, a sucking device and a tube. The tub body has a receiving space, an inlet communicating with the receiving space and a communication portion for communicating with the receiving space. The tub body is for arrangement on a barrel body and defines at least one passage with the barrel body. The sucking device is for disposed in the barrel body. The tube is connected with the sucking device and has an outlet. When the sucking device is disposed in the barrel body, the tube extends from an interior of the barrel body outside the barrel body through one of the passages, and the outlet is controllably arranged substantially toward the inlet of the tub body.

12 Claims, 5 Drawing Sheets

RECYCLING CLEANING DEVICE

BACKGROUND OF THE INVENTION

Field of the Invention

The present invention relates to a cleaning device, and more particularly to a recycling cleaning device.

Description of the Prior Art

Most of the time, when cleaning an object, people wash the object in a specific place, for example, a kitchen counter. When cleaning mechanical components, people need to use specific cleaning liquid because of oil stains and scraps attached on the mechanical components. To prevent liquid containing greasy dirt from being discharged directly and polluting the environment, people are asked to use a specific cleaning device which has the functions of providing the cleaning liquid and preserving the waste liquid. This type of cleaning device is disclosed in TW370903.

However, in this type of prior arts, a user needs to be beside the cleaning device to use the cleaning device. If the user moves the cleaning device to his/her side, the cleaning device which has greater volume occupies working space and hinders the user from work, and the cleaning device is not suitable to be used in small shops or at home. In addition, the cleaning liquid in this type of cleaning device cannot be recycled and is not cheap, so it is not economical for the user to use this type of cleaning device.

The present invention has arisen to mitigate and/or obviate the afore-described disadvantages.

SUMMARY OF THE INVENTION

The major object of the present invention is to provide a recycling cleaning device. A user can easily and quickly combine the recycling cleaning device with a barrel body to clean an object. In addition, the recycling cleaning device has a simple structure and is small, and a cleaning liquid is recyclable. Waste liquid which is produced after cleaning can be recycled back into the barrel body and taken to other places for further processing.

To achieve the above and other objects, a recycling cleaning device is provided, including a tub body, a sucking device and a tube. The tub body is for disposed on a barrel body, and the barrel body is for receiving a liquid. The tub body has a receiving space, an inlet communicating with the receiving space and a communication portion for communicating with an interior of the barrel body and the receiving space, the tub body and the barrel body define at least one passage therebetween, and each said passage is for communicating with outside and the interior of the barrel body. The sucking device is for being disposed in the interior of the barrel body to suck the liquid. The tube is connected with the sucking device and has an outlet. When the sucking device is disposed in the interior of the barrel body, the tube extends from the interior of the barrel body and passes outside the barrel body through one said passage, and the outlet is controllably arranged substantially toward the inlet, wherein the liquid is sucked by the sucking device, through the tube and output from the outlet, and the liquid enters the receiving space from the inlet and flows back into the interior of the barrel body through the communication portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
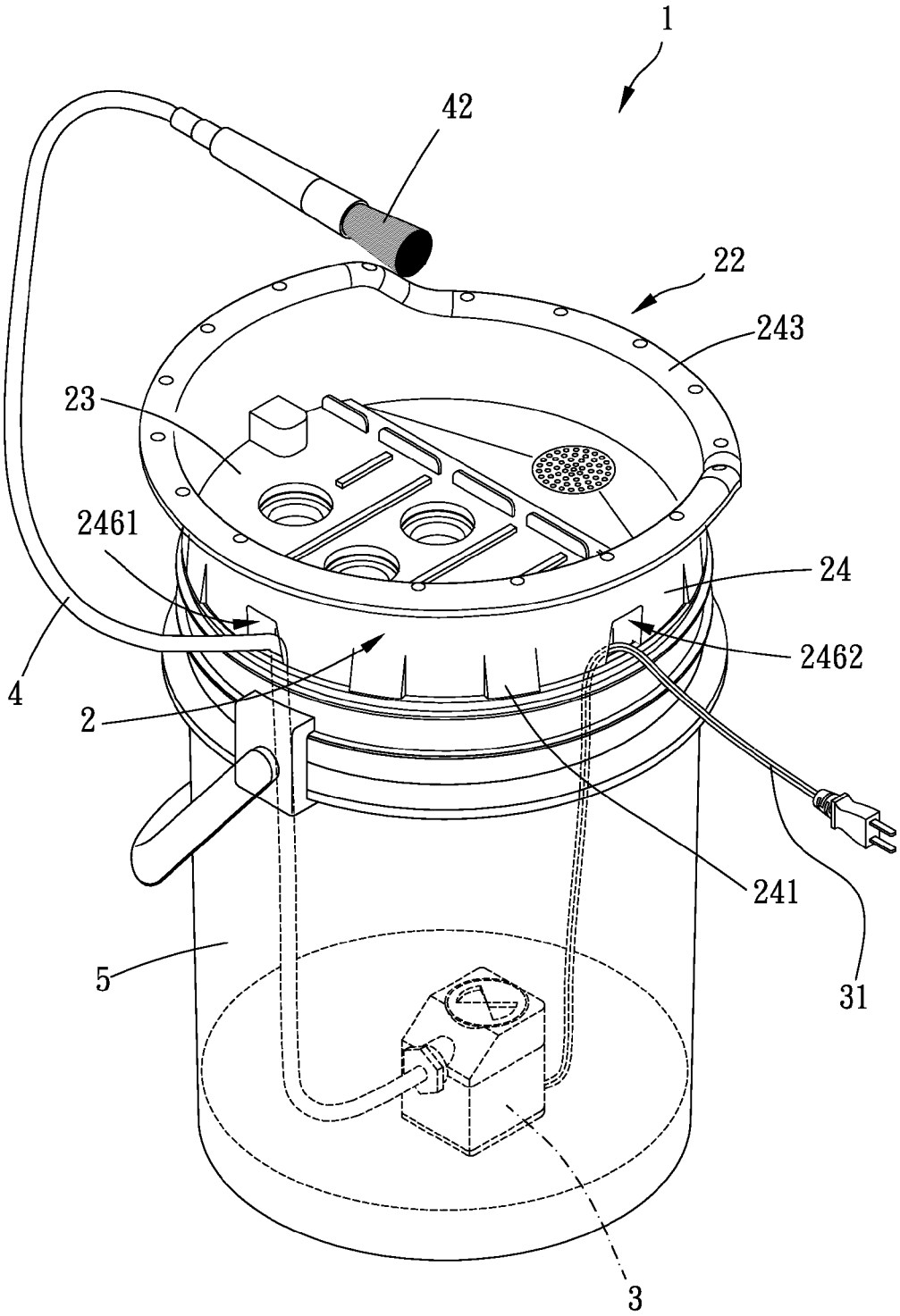
FIG. 1 is a perspective view of an embodiment of the present invention.
Figure 2:
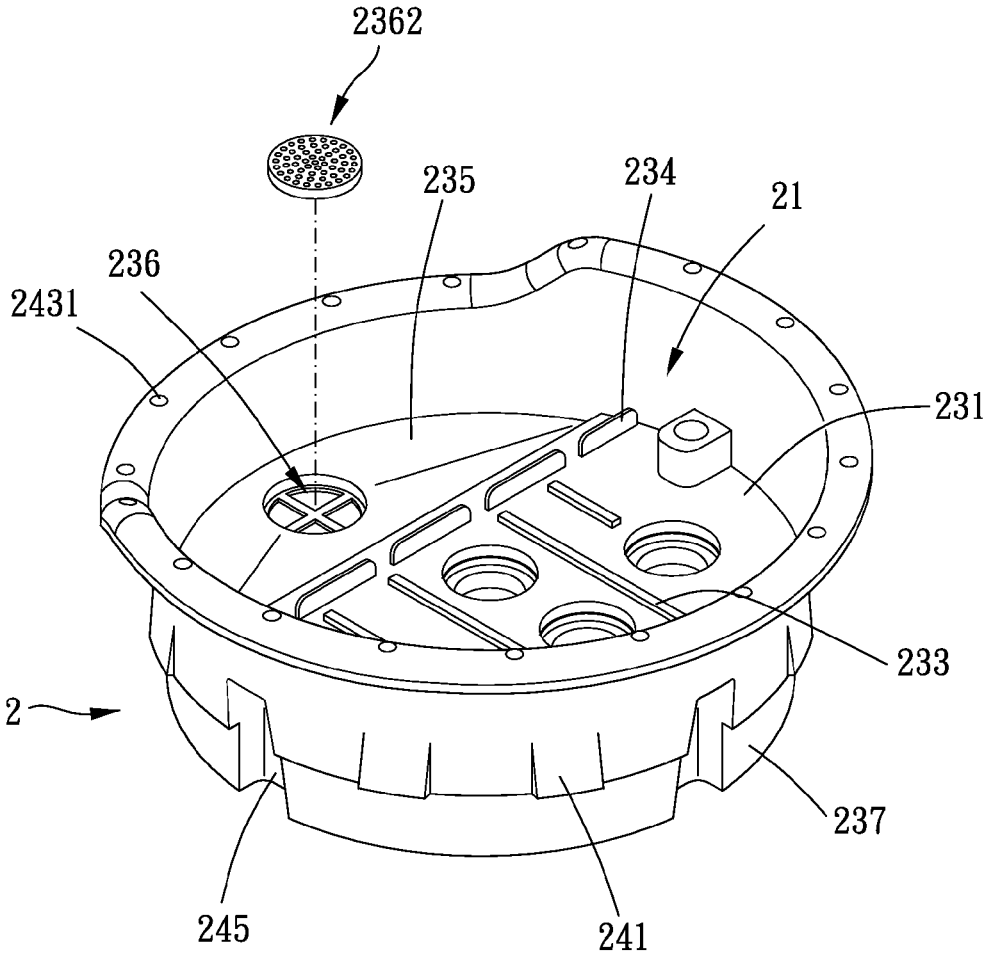
FIG. 2 is a drawing showing a part of components of the embodiment of the present invention.
Figure 3:
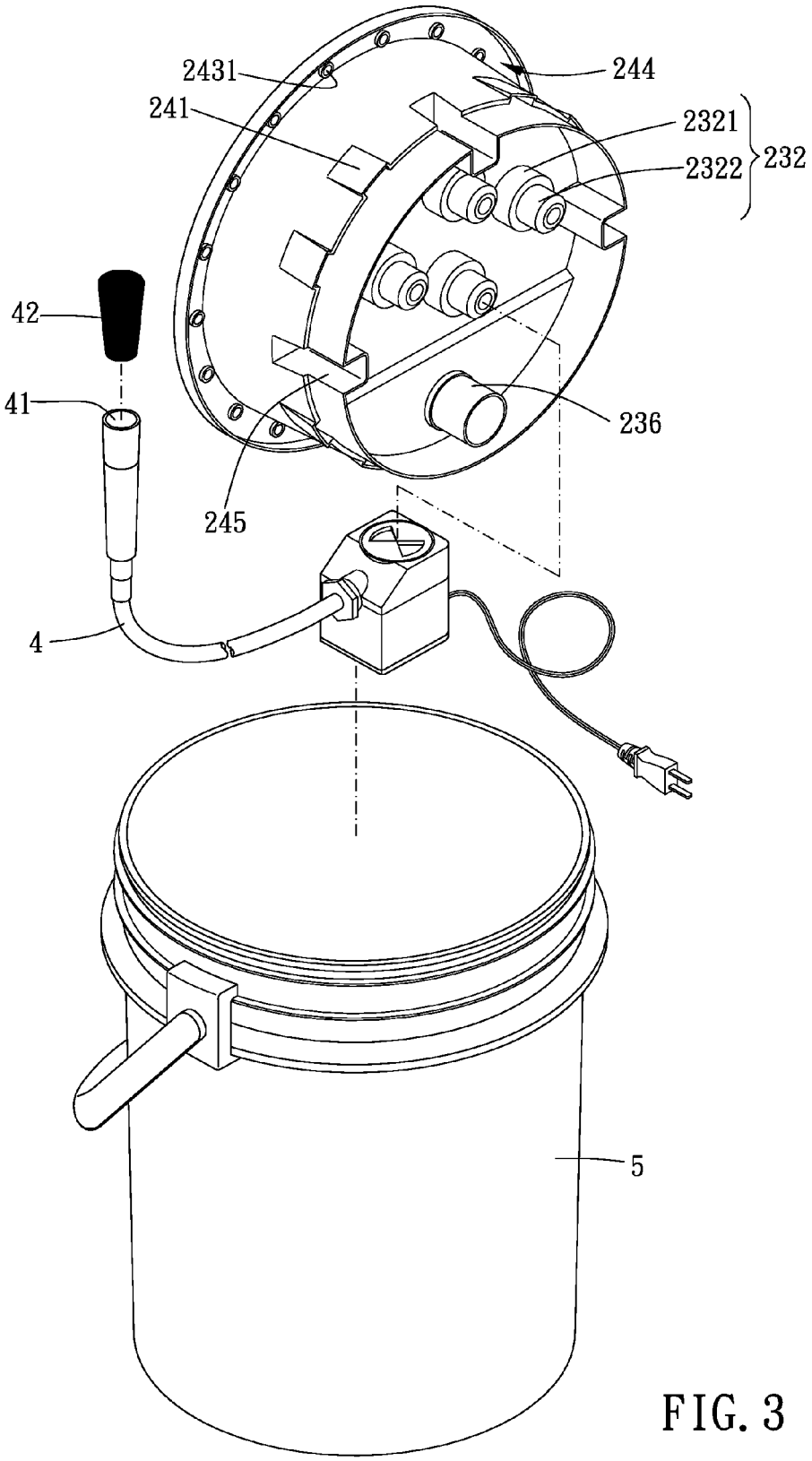
FIG. 3 is a drawing showing an assembly of FIG. 1.
Figure 4:
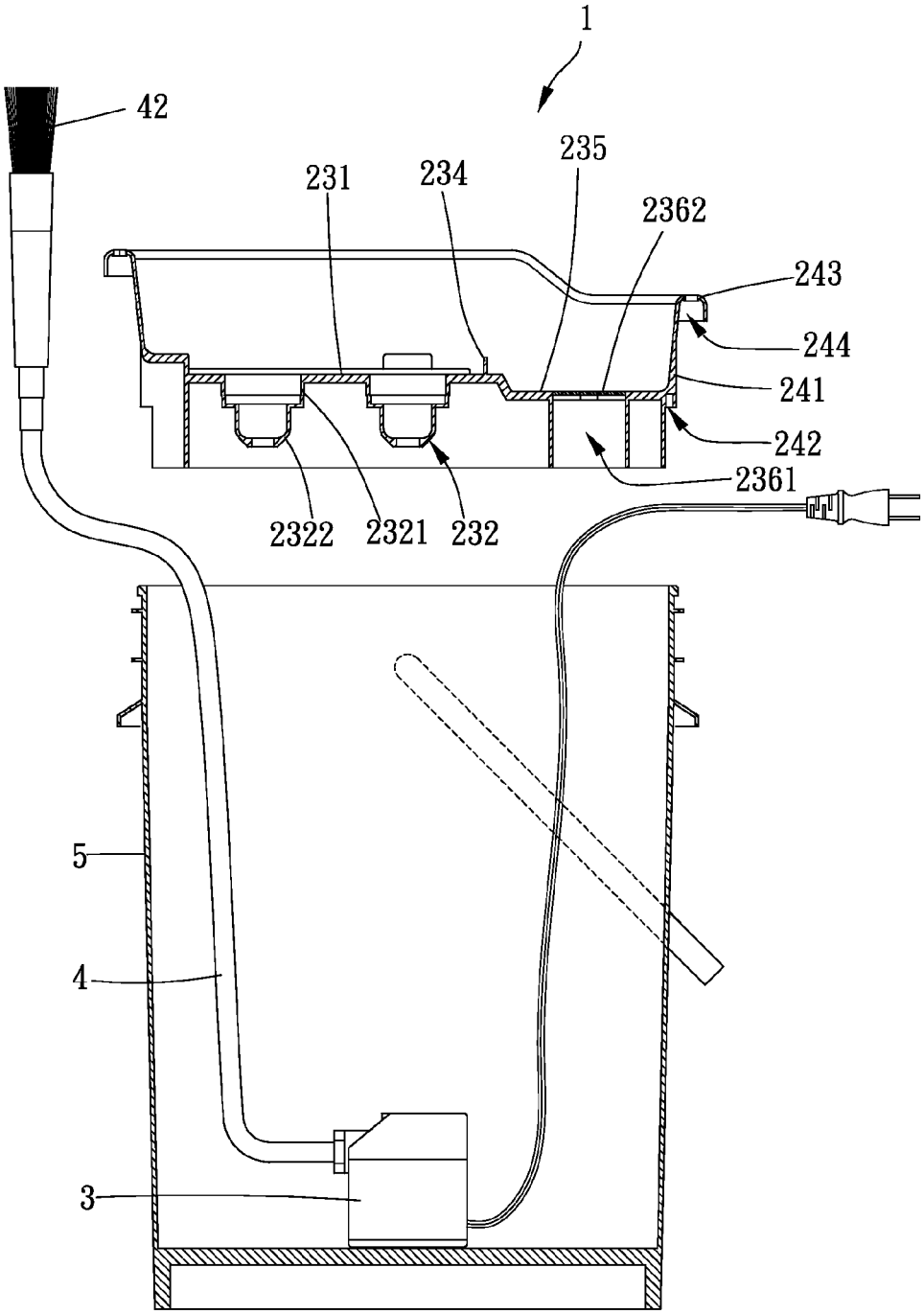
FIG. 4 is a side cross-sectional view of the embodiment of the present invention.
Figure 5:
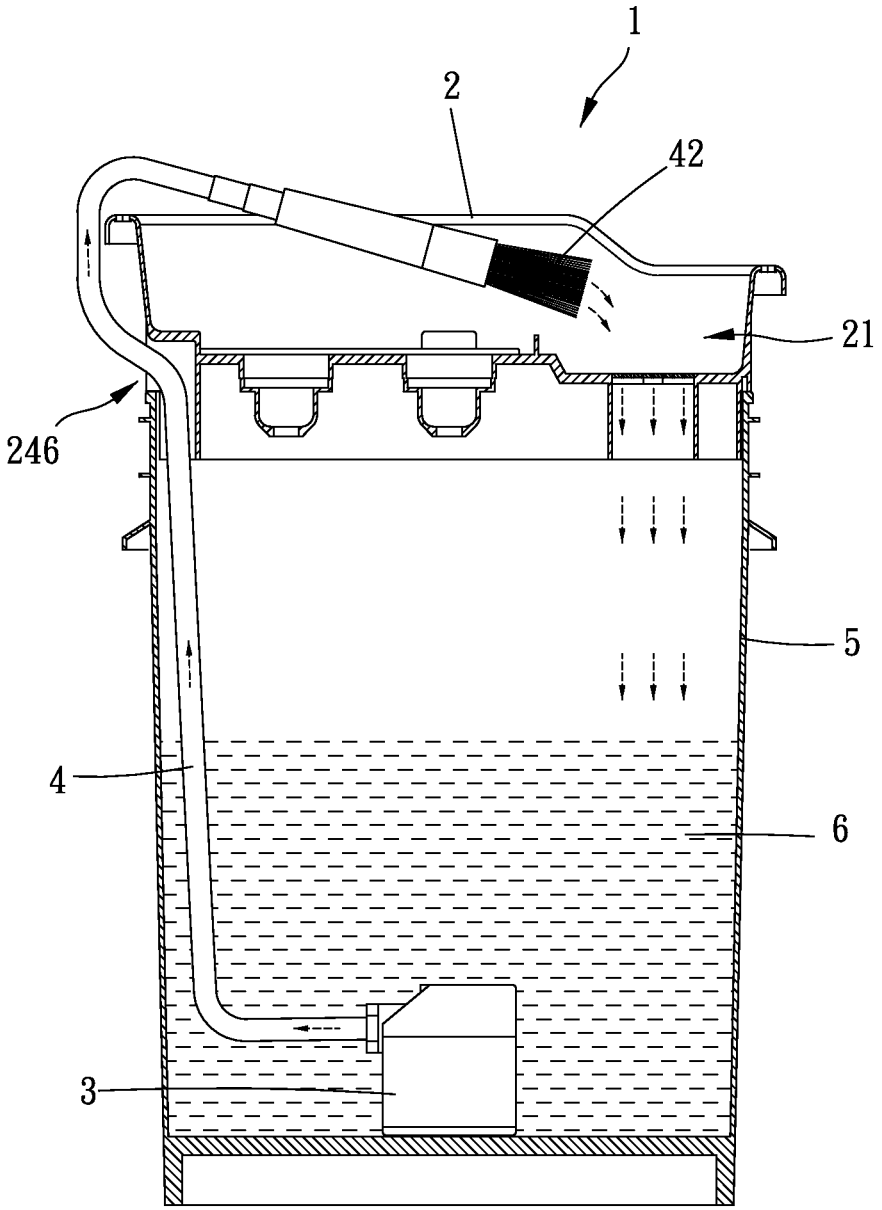
FIG. 5 is a drawing showing the embodiment of the present invention in use.

Please refer to FIGS. 1 to 5 for a preferred embodiment of the present invention. A recycling cleaning device 1 includes a tub body 2, a sucking device 3 and a tube 4.

The tub body 2 is for being disposed on a barrel body 5 (for example, a 5-gallon barrel), the barrel body 5 is for receiving a liquid 6 (for example, oil or cleaning liquid), the tub body 2 has a receiving space 21, an inlet 22 which communicates with the receiving space 21 and a communication portion 236 which is for communicating with an interior of the barrel body 5 and the receiving space 21, the tub body 2 and the barrel body 5 define at least one passage 246 therebetween, and each said passage 246 is for communicating with outside and the interior of the barrel body 5. The sucking device 3 is for being disposed in the interior of the barrel body 5 to suck the liquid 6. The tube 4 is connected with the sucking device 3 and has an outlet 41. When the sucking device 3 is disposed in the interior of the barrel body 5, the tube 4 extends from the interior of the barrel body 5 and passes outside the barrel body 5 through one said passage 246, and the outlet 41 is controllably arranged substantially toward the inlet 22; wherein the liquid 6 is sucked by the sucking device 3, through the tube 4 and output from the outlet 41, and the liquid 6 enters the receiving space 21 from the inlet 22 and flows back into the interior of the barrel body 5 through the communication portion 236.

Specifically, the tub body 2 further has a base 23 and a circumferential wall 24 connected with the base 23, and the base 23 and the circumferential wall 24 define the receiving space 21. When viewed from a direction facing the base 23, a contour of the base 23 is substantially round. Wherein, the base 23 has a first region 231 and a second region 235 which communicates with the first region 231 and is lower than the first region 231, and the communication portion 236 is disposed on the second region 235. Through the stepped design, the liquid 6 on the first region 231 can flow toward the communication portion 236 effectively so as to prevent the liquid 6 from accumulating on the first region 231. Preferably, the first region 231 is formed with at least one split rib 233 which extends toward the second region 235, and the at least one split rib 233 guides the liquid 6 to move along each said split rib 233. Preferably, the base 23 is further formed with at least one blocking member 234, and the at least one blocking member 234 is transverse to the at least one split rib 233 respectively to block impurities which is mixed in the liquid 6. In other words, each said blocking member 234 serves as a filter.

In this embodiment, the first region 231 is formed with a plurality of said split ribs 233, the base 23 is formed with a plurality of said blocking members 234, each of the split ribs 233 is parallel to one another, the blocking members 234 are equidistantly arranged, and an extending direction of each said blocking member 234 is perpendicular to each said split rib 233. In addition, because the tub body 2 is directly covered on the barrel body 5, the communication portion 236 is designed to be a through hole 2361 to simplify a structure of the tub body 2 and to allow the liquid 6 to quickly flow from the receiving space back into the interior of the barrel body 5. Preferably, the through hole 2361 further has a filter structure 2362 to filter the liquid 6 which contains impurities so that the liquid 6 which enters the interior of the barrel body 5 can be maintained clean and recyclable. Wherein, the filter structure 2362 may be a screen which extends from the through hole 2361 or a filter lid which is covered on the through hole 2361. Furthermore, preferably, the outlet 41 is further provided with a brush member 42, and the brush member 42 is for brushing an object to remove the impurites which have greater adherence. It is to be noted that when the liquid 6 is unusable, the liquid 6 is a waste liquid. The user only needs to first take out the tub body 2, the sucking device 3 and the tube 4 from the barrel body 5 and then arrange the tub body 2, the sucking device 3 and the tube 4 in another barrel body, and the barrel body 5 which receives the waste liquid can be sealed directly and taken to other places for further processing, thus facilitating recycling of discarded liquid.

More specifically, in addition to the sucking device 3 having a built-in power, the sucking device 3 is normally provided with a power wire 31. It is understandable that the power wire 31 of the sucking device 3 also needs to extend out of the barrel body 5. In order to prevent the power wire 31 and the tube 4 from tangling with each other when in a same one said passage 246, preferably, the tub body 2 and the barrel body 5 define at least two said passages 246; wherein one of the passages 246 serves as a first passage 2461, one of the passages 246 serves as a second passage 2462, the tube 4 is disposed through the first passage 2461, and the power wire 31 of the sucking device 3 is disposed through the second passage 2462. In this embodiment, the circumferential wall 24 of the tub body 2 is further formed with three recesses 245, and the recess 245 and the barrel body 5 form the passage 246; wherein an extending direction of the first passage 2461 and a center of the base 23 and an extending direction of the second passage 2462 and the center of the base 23 are substantially perpendicular to each other.

It is understandable that the tub body 2 is further formed with at least one abutting portion 241, and each said abutting portion 241 is for abutting against an opening end of the barrel body 5 so that the tub body 2 is positioned on the opening end of the barrel body 5. In this embodiment, each said abutting portion 241 protrudes from the circumferential wall 24, and the at least one abutting portion 241 is equidistantly arranged between either two said recesses 245 so as to stably support the tub body 2 and prevent the tub body 2 form shaking during operation. Preferably, each said abutting portion 241 and the circumferential wall 24 define an insertion opening 242. When a gap between a portion of the opening end of the barrel body 5 and the tub body 2 is greater, an insertion member (not shown) may be inserted into the insertion opening 242, and the insertion member laterally abuts against an outer wall of the barrel body 5 to prevent the tub body 2 from moving horizontally relative to the barrel body 5. In other words, the insertion member allows the tub body 2 to be stably connected with the barrel body 5. Preferably, the base 23 is further formed with a propping portion 237 for abutting against an inner wall of the barrel body 5, and the propping portion 237 is located below each said abutting portion 241. When viewed from the direction facing the base 23, the propping portion 237 is not protrusive from the base 23. When the tub body 2 slides relative to the barrel body 5, the propping portion 237 can prevent the tub body 2 from falling onto a ground.

In addition, an end of the circumferential wall 24 opposite to the base 23 extends to form a lip portion 243, and the lip portion 243 and the circumferential wall 24 form a ditch 244 for fingers to insert therein for gripping the tub body 2 firmly. Preferably, the lip portion 243 is formed with a plurality of through holes 2431, and each said through hole 2431 is for a tool to insert thereinto; therefore, the user does not have to find another space to put the tool. It is to be noted that a cleaning liquid sold on the market is sealed in a container, and the cleaning liquid is pull into the barrel body 5 when the user wants to use the cleaning liquid; therefore, the first region 231 is preferably further formed with at least one liquid-guiding portion 232 which communicates with the interior of the barrel body 5 and the receiving space 21, each said liquid-guiding portion 232 extends toward a direction away from the base 23, and each said liquid-guiding portion 232 is for the opening end of the container to insert therein so that the cleaning liquid can flow into the interior of the barrel body 5 through the liquid-guiding portion 232 without spilling to outside. More preferably, each said liquid-guiding portion 232 has a first mouth 2321 and a second mouth 2322, and the first mouth 2321 is wider than the second mouth 2322, and the first and second mouths 2321, 2322 are steppedly arranged so that each said liquid-guiding portion 232 is applicable to containers the opening ends of which are in different dimensions and are further formed with a circumferential protrusive rib.

Given the above, the recycling cleaning device can recycle the cleaning liquid, so it is environment-friendly and economic. In addition, the recycling cleaning device has a simple structure and is small, so it saves space and can be placed near the user.

In addition, through the split design, the tub body, the sucking device and the tube can be quickly assembled to the original barrel body; and after use, the user only needs to take out the tub body, the sucking device and the tube and assemble them to another barrel body, and then s/he can continue to use the recycling cleaning device without pulling out the waste liquid. The user only has to seal the original barrel body with the waste liquid inside and take the original barrel body to other places for further processing.

While we have shown and described various embodiments in accordance with the present invention, it should be clear to those skilled in the art that further embodiments may be made without departing from the scope of the present invention.

What is claimed is:

1. A recycling cleaning device, including:

a tub body, provided for being disposed on a barrel body, the barrel body being for receiving a liquid, the tub body having a receiving space, an inlet communicating with the receiving space and a communication portion for communicating with an interior of the barrel body and the receiving space, the tub body and the barrel body defining at least one passage therebetween, each said passage provided for communicating with outside and the interior of the barrel body;

a sucking device, provided for being disposed in the interior of the barrel body to suck the liquid;

a tube, connected with the sucking device and having an outlet;

wherein when the sucking device is disposed in the interior of the barrel body, the tube extends from the interior of the barrel body and passes outside the barrel body through one said passage, and the outlet is controllably arranged substantially toward the inlet; wherein the liquid is sucked by the sucking device, through the tube and output from the outlet, the liquid enters the receiving space from the inlet and flows back into the interior of the barrel body through the communication portion;

wherein the tub body is further formed with at least one abutting portion, and each said abutting portion is for abutting against an opening end of the barrel body so that the tub body is positioned on the opening of the barrel body;

wherein the tub body further has a base and a circumferential wall connected with the base, the base and the circumferential wall define the receiving space, and each said abutting portion protrudes from the circumferential wall;

wherein each said abutting portion and the circumferential wall define an insertion opening.

2. The recycling cleaning device of claim 1, wherein the communication portion is a through hole.

3. The recycling cleaning device of claim 2, wherein the through hole is further provided with a filter structure.

4. The recycling cleaning device of claim 1, wherein the tub body and the barrel body define at least two said passages, wherein one of the passages serves as a first passage, one of the passages serves as a second passage, the tube is disposed through the first passage, and a power wire of the sucking device is disposed through the second passage.

5. A recycling cleaning device, comprising:

a tub body, provided for being disposed on a barrel body, the barrel body being for receiving a liquid, the tub body having a receiving space, an inlet communicating with the receiving space and a communication portion for communicating with an interior of the barrel body and the receiving space, the tub body and the barrel body defining at least one passage therebetween, each said passage provided for communicating with outside and the interior of the barrel body;

a sucking device, provided for being disposed in the interior of the barrel body to suck the liquid;

a tube, connected with the sucking device and having an outlet;

wherein when the sucking device is disposed in the interior of the barrel body, the tube extends from the interior of the barrel body and passes outside the barrel body through one said passage, and the outlet is controllably arranged substantially toward the inlet wherein the liquid is sucked by the sucking device, through the tube and output from the outlet, the liquid enters the receiving space from the inlet and flows back into the interior of the barrel body through the communication portion;

wherein the tub body further has a base and a circumferential wall connected with the base, the base and the circumferential wall define the receiving space, an end of the circumferential wall opposite to the base extends to form a lip portion, and the lip portion and the circumferential wall form a ditch which is for fingers to insert therein.

6. The recycling cleaning device of claim 5, wherein the lip portion is formed with a plurality of through holes, and each said through hole is for a tool to insert thereinto.

7. A recycling cleaning device, comprising:

a tub body, provided for being disposed on a barrel body, the barrel body being for receiving a liquid, the tub body having a receiving space, an inlet communicating with the receiving space and a communication portion for communicating with an interior of the barrel body and the receiving space, the tub body and the barrel body defining at least one passage therebetween, each said passage provided for communicating with outside and the interior of the barrel body;

a sucking device, provided for being disposed in the interior of the barrel body to suck the liquid;

a tube, connected with the sucking device and having an outlet;

wherein when the sucking device is disposed in the interior of the barrel body, the tube extends from the interior of the barrel body and passes outside the barrel body through one said passage, and the outlet is controllably arranged substantially toward the inlet; wherein the liquid is sucked by the sucking device, through the tube and output from the outlet, the liquid enters the receiving space from the inlet and flows back into the interior of the barrel body through the communication portion;

wherein the tub body further has a base and a circumferential wall connected with the base, the base and the circumferential wall define the receiving space, the base has a first region and a second region which communicates with the first region and is lower than the first region, and the communication portion is disposed on the second region.

8. The recycling cleaning device of claim 7, wherein the first region is further formed with at least one liquid-guiding portion which communicates with the interior of the barrel body and the receiving space, and each said liquid-guiding portion is for an opening end of a container to insert thereinto.

9. The recycling cleaning device of claim 8, wherein each said liquid-guiding portion extends toward a direction away from the base, each said liquid-guiding portion has a first mouth and a second mouth, and the first mouth is wider than the second mouth.

10. The recycling cleaning device of claim 7, wherein the first region is formed with at least one split rib extending toward the second region.

11. The recycling cleaning device of claim 10, wherein the base is further formed with at least one blocking member, and the at least one blocking member is transverse to the at least one split rib.

12. The recycling cleaning device of claim 11, wherein the first region is formed with a plurality of said split ribs, the base is formed with a plurality of said blocking members, each of the split ribs is parallel to one another, the blocking members are equidistantly arranged, an extending direction of each said blocking member is perpendicular to each said split rib, when viewed from a direction facing the base, a contour of the base is substantially round; an circumferential wall of the tub body is further formed with three recesses, the recess and the barrel body define the passage, wherein one of the passages serves as a first passage, one of the passages serves as a second passage, the tube is disposed through the first passage, a power wire of the sucking device is disposed through the second passage, an extending direction of the first passage and a center of the base is substantially perpendicular to an extending direction of the second passage and the center of the base; the first region is further formed with four said liquid-guiding portions which communicate with the interior of the barrel body and the receiving space, each said liquid-guiding portion is provided for an opening end of a container to insert thereinto, each said liquid-guiding portion extends toward a direction away from the base, each said liquid-guiding portion has a first mouth and a second mouth, and the first mouth is wider than the second mouth; the communication portion is a through hole, the through hole further has a filter structure; the tube body is further formed with at least one abutting portion, each said abutting portion protrudes from the circumferential wall, each said abutting portion is provided for abutting against an opening end of the barrel body so that the tub body is positioned on the opening end of the barrel body, and the at least one abutting portion is equidistantly arranged between either two said recesses; in addition, each said abutting portion and the circumferential wall define an insertion opening for an insertion section to be inserted and positioned therein; an end of the circumferential wall opposite to the base extends to form a lip portion, the lip portion and the circumferential wall form a ditch for fingers to insert therein; the lip portion is formed with a plurality of through holes, each said through hole is for a tool to insert thereinto; a brush member is further disposed on the outlet, the brush member is for brushing an object; the base is further formed with a propping portion for abutting against the inner wall of the barrel body, the propping portion is located below each said abutting portion, and when viewed from the direction facing the base, the propping portion non-protrudes out of the base.

* * * * *